United States Patent [19]

Browne et al.

[11] Patent Number: 4,706,398

[45] Date of Patent: Nov. 17, 1987

[54] MULTICOLOR INDICATOR WITH ARCUATE POLE PIECES

[75] Inventors: John Browne, Georgetown; Matthew Dennis, Mississauga, both of Canada

[73] Assignee: NEI Canada Limited, Toronto, Canada

[21] Appl. No.: 835,178

[22] Filed: Mar. 3, 1986

[51] Int. Cl.[4] ..... G09F 9/00

[52] U.S. Cl. ..... 40/449; 540/815.26

[58] Field of Search ..... 40/449, 466, 473; 340/815.26, 815.27; 335/272; 310/185

[56] References Cited

U.S. PATENT DOCUMENTS

| | | | |
|---|---|---|---|
| 3,307,170 | 2/1967 | Aoyama et al. | 340/815.27 |
| 3,435,392 | 3/1969 | Ouellette et al. | 340/815.26 |
| 4,001,815 | 1/1977 | Gamble | 340/815.26 |
| 4,521,983 | 6/1985 | Wakatake | 40/449 |
| 4,558,529 | 12/1985 | Chang et al. | 40/449 |

FOREIGN PATENT DOCUMENTS

| | | | |
|---|---|---|---|
| 2170638 | 8/1986 | United Kingdom | 340/815.26 |

OTHER PUBLICATIONS

IBM Technical Disclosure, vol. 2, No. 2, Aug. 1959, Middelhock, S. and Wiedmer, F., *Numeral Indicator.*

*Primary Examiner*—Gene Mancene
*Assistant Examiner*—Cary E. Stone

[57] ABSTRACT

A display element has a rotor designed to assume 3 or 4 angular positions to display corresponding panels on a viewing direction. The rotor has a permanent magnet at an angle to the axis. The position of the permanent magnet and rotor are controlled by stationary pairs of pole piece tips adjacent but spaced from each other, located adjacent the locus of the magnet at locations spaced by the angle between adjacent locations.

19 Claims, 7 Drawing Figures

FIG. 4
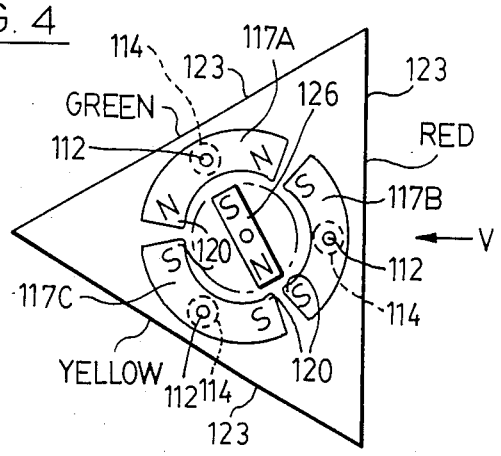
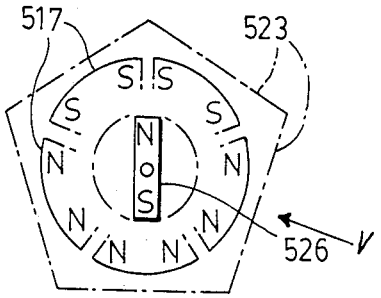
FIG. 5
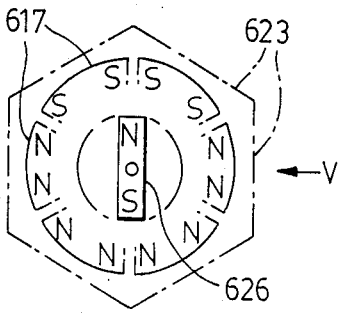
FIG. 6
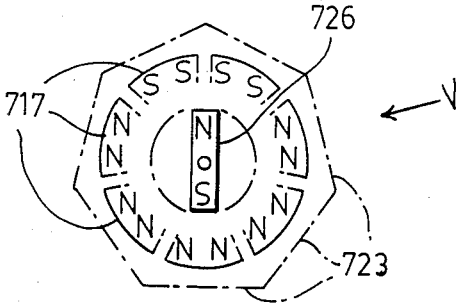
FIG. 7

MULTICOLOR INDICATOR WITH ARCUATE POLE PIECES

This invention relates to an electromagnetic display element wherein a rotor bearing three or more display panels is electromagnetically controlled to display a selectable one of said panels in a viewing direction.

In this application a 'multi-color' display element means an element designed to selectively display one of three or more panels in the viewing direction.

There are a large number of display elements, electromganetically operated, whose rotors are in the form of disks differently colored on opposite sides and which may be operated to display one or the other disk face in the viewing direction.

There are a small number of display elements for displaying a selected one of three or more differently colored panels in the viewing direction. A recent element of this type is shown in U.S. Pat. No. 4,177,458 to Nihon Advanced Products K. K. Although the device of this patent is suitable for showing any one of four differently colored panels in a viewing direction, it has the disadvantage that it is not possible to switch directly from displaying any one panel to displaying any other panel, but instead the rotor displaying one panel must be reset to a datum position before being moved to display the new panel.

It is an object of this invention to provide an electromagnetically operable multi-color display element using a rotor carrying a permanent magnet having three or more panels of different color and controls to cause said rotor to assume a selectable position to display any selected one of said panels in the display direction, and where said element is designed to switch from any panel to any other panel without requiring intermediate resetting to a datum position.

It is a further object of the invention to provide a display element as described in the previous paragraph wherein the electromagnetic core for providing the controlling field in a preferred alternative uses high coercivity high remanence magnetic material whereby the time to "set" the polarity of the core is much less than the time for the rotor to assume its ultimate position, and hence a single control element may "set" or "write" many such cores during the time it takes any one of such element rotors to move from a first to a second selected position. This is a significant advantage when it is realized that such multi-color elements will frequently be employed in large numbers arranged to form an array, and it is desired to simplify the control or "write" circuitry so far as possible.

However, it should be noted that the invention includes the alternative where the electromagnetic core for providing the controlling field is of low remanence or soft iron. With the soft iron core the pulse to drive the rotor to a new desired position must be maintained until the rotor reaches that position, and the rotor in the new position remains there, not because of core remanence but because the permanent rotor magnet magnetizes the core from which the setting pulse has been removed.

It is a further object of the invention to provide a multi-color display element, as described in one of the previous two paragraphs wherein pairs of pole piece tips are located adjacent the locus of the permanent magnet, at each angular location where a pole of the permanent magnet is to come to rest to display a panel of the rotor in a viewing direction. By selecting the right magnetic polarity for each pole piece, the tip pairs corresponding to the desired position for the permanent magnet pole are given the same polarity which is opposite to the permanent magnet pole to be attracted. Other pole piece pairs are of opposite polarities (other than (in some cases) pairs at angles including the direction 180° to the 'corresponding' pair). In the opposite polarity pairs the flux is mainly between the opposite polarity tips and tends to have small effect on the magnet.

Two pole piece tips corresponding to angularly adjacent tip pair positions are part of the same pole piece and the tips are cyclically paired about the magnet locus so that in a four position device where a,b,c,d represent four pole pieces, the tip pairs are AB, BC, CD and DA where 'A' is a tip of pole piece 'a' and so on. It will be noted that in the four position device, four tip pairs may be provided having the polarities NN NS SS SN beginnirg at any one of the 90° separated angular locations so at any of the four positions for the rotor is uniquely selectable by proper magnetization of the pole pieces. Similar1y, with a three position device, the three tip pairs may have the tip pairs NN NS SN (starting with any tip) determining three positions 120° about for the rotor with the S pole of the permanent magnet directed at the NN tips as selected from time to time. Although the invention is mainly concerned with three and four positions, it is noted that more positions are available as hereinafter explained.

The tip pairs are adjacent but spaced so that they have a relatively high effect on the permanent magnet when similarly polarized and a relatively low effect (due to flux leakage between the pole tips) when oppositely polarized. The most efficient and economical arrangement is achieved when the pole pieces are placed all essentially in the same plane with tips at their ends projecting nearer the permanent magnet locus than the joining portion of the pole piece, and with the tips of the tip pairs spaced a small amount along a direction parallel to but outside the locus.

The pole pieces are preferably of low coercivity and are preferably controlled by high coercivity, high remanence cores. Such cores, as previously noted may be "set" or polarized in a small fraction of the time that the rotor requires to turn between two angular locations. This, as previously discussed, assists in the efficient setting cf a large number of cores in a multi-element array. It also contributes to the fact that with the tip pairs of the invention the rotor may be switched from any one location to any other location without intermediate return to a datum and to the fact that the pole piece permutations are unique for each desired totor position.

Without limitation it is noted that the order of the setting time of a high coercivity, high remanence core is very short, but due to self-inductrance, current rise time in the associated core can take ½ to 1 ms to achieve saturation flux density : while the time for the roation of the rotor over 90° is of the order of 100–200 ms.

In drawings which illustrate a preferred embodiment of the invention:

Figure 2:
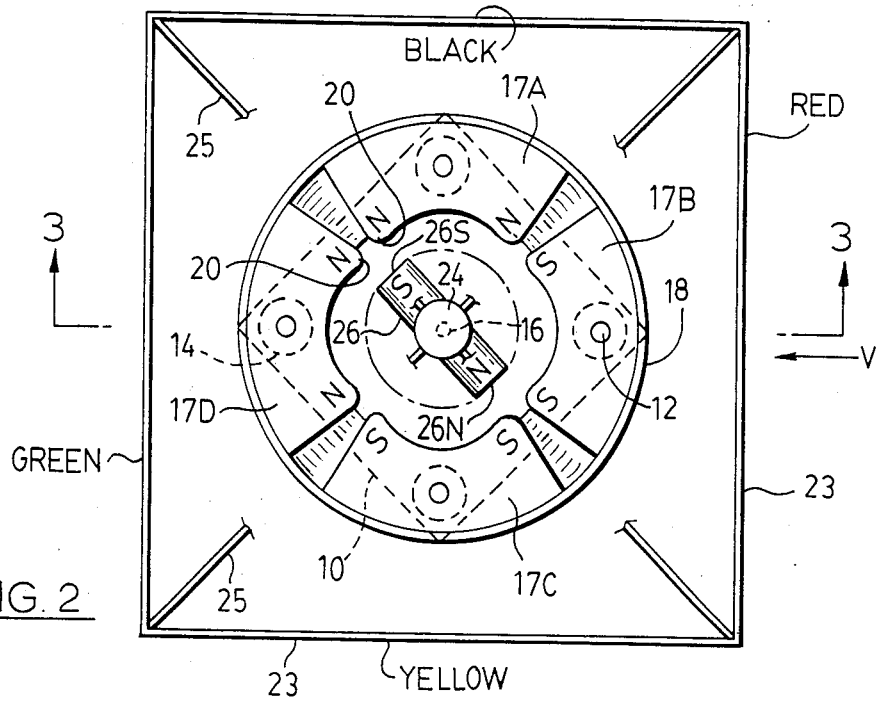
FIG. 2 shows a view of the invention along the axis of the rotor.
Figure 3:
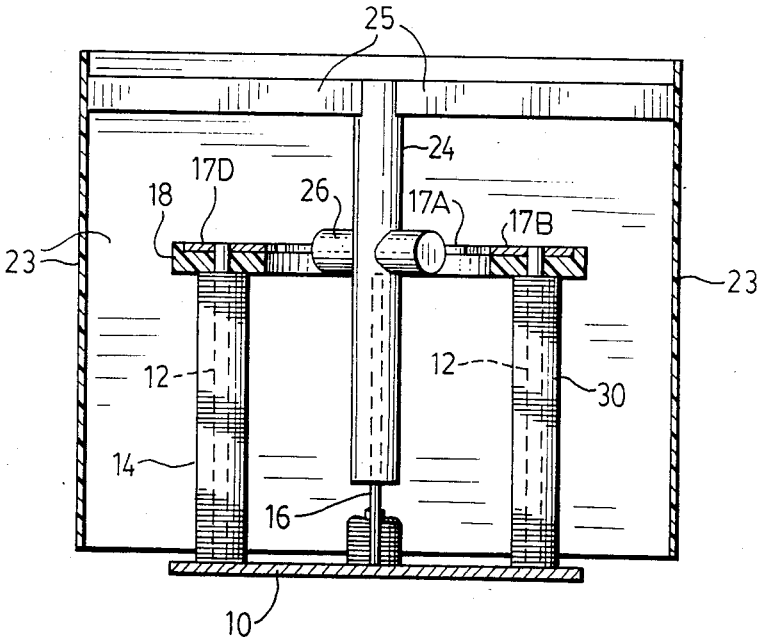

FIG. 3 shows a section, taken parallel to the rotor axis along the lines 3—3 of FIG. 2, FIG. 4 shows an axial view of a three position rotor and the figure is analogous to FIG. 2; and FIGS. 5, 6 and 7 show schematic views of 5, 6 and 7 position devices.

Figure 1:
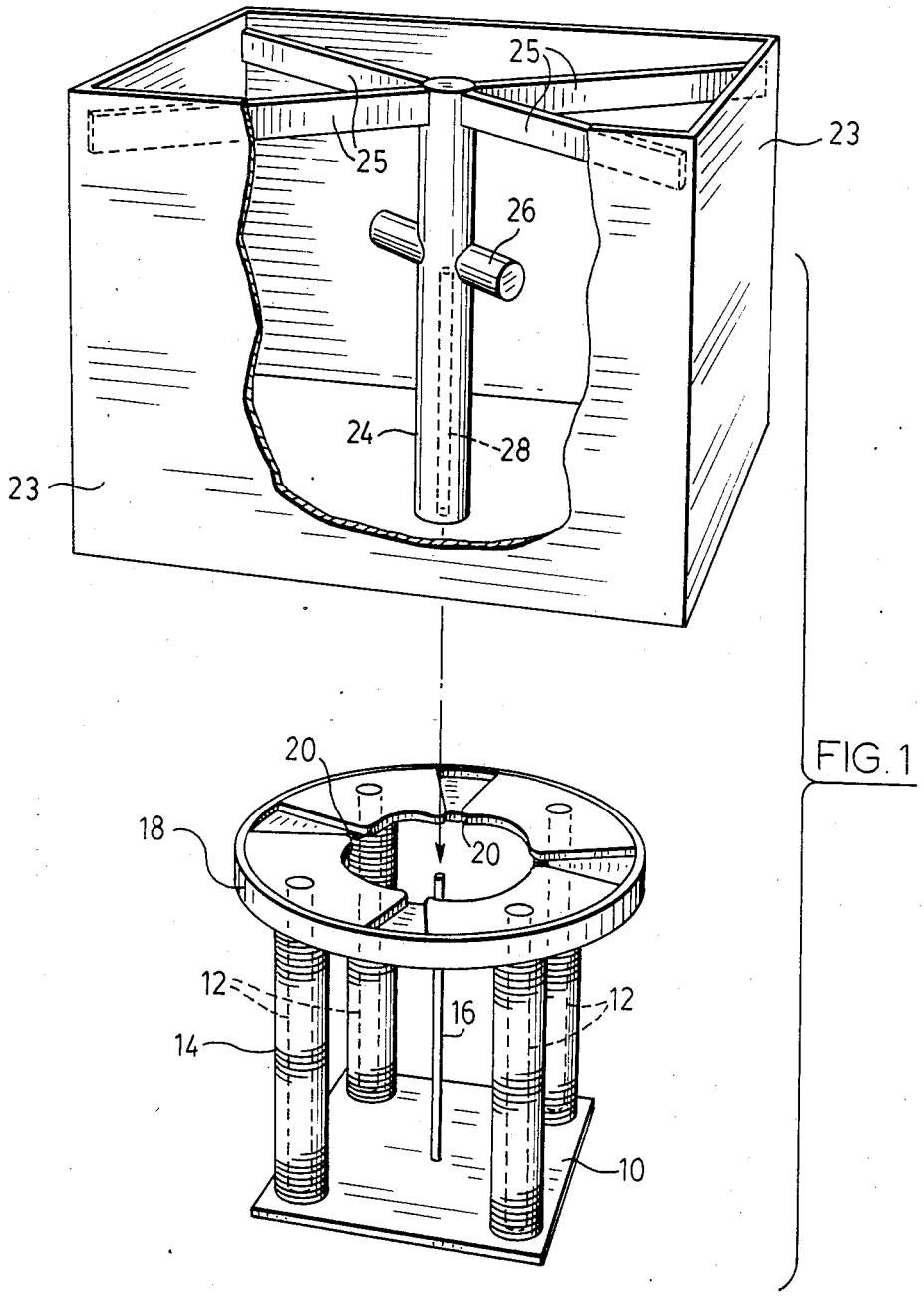
FIG. 1 shows a perspective view, in exploded form of a display element in accord with the invention.

In the FIGS. 1-3 of the drawings, the stator comprises a return plate 10 of low coercivity or "soft" magnetic material, having four cores 12 upwardly standing therefrom and defining the corners of a square when viewed endwise. Energizing coils 14 are provided surrounding each of the cores. The cores 12 are made of high coercivity, high remanence magnetic material, and are thus designed to retain any polarity provided by a "set" or "write" pulse of the energizing coils without the requirement of sustaining current in the coils. Thus, high coercivity prevents alteration of the polarity by an adjacent permanent magnet.

A support shaft 16 extends from return plate 10 parallel to and centrally disposed in plan view from cores 12. Shaft 16 defines the rotor axis.

A pcle piece 17 is mounted on the upper end of each core. A circular support ring 18 of a non-magnetic material is attached to and supports the outer periphery of the pole pieces. Thus, the pole pieces, as shown, have outer peripheries conforming to the ring. The inner periphery of the pole piece has an intermediate extent further from the rotor axis than the tips 20 of the pole pieces. Thus, adjacent plates (e.g. 17A, 17B) provide a pair of tips, one from each of the adjacent pole pieces, with a small air gap therebetwen. For ease and economy of construction and effective magnetic control of the rotor, each of the plates 17 is a flat plate and such plates are substantially co-planar. Thus it will be noted that the path across the gaps is preferably perpendicular to the radial direction.

The rotor provides for equal sides defining a square in plan view with four panels 23 being each of a different color indicated as red, yellow, green, black. The panels are supported on a central post 24 in any desired manner, such as by the four diagonal struts 25. The central post 24 is provided with a central bore 28, extending upwardly from the bottom to a blind end to receive shaft 16, and of a length to position the panels 23 and the remainder of the rotor at the desired height as hereinafter discussed. Means of axial shaft restraint are not shown, but many methods could be used.

A permanent magnet 26 is mounted on the post 24 to rotate therewith. Although the magnet is shown as a bar projecting through a bore in the post 24, the permanent magnet and its mounting may take any of a large number of forms, all well known to those skilled in the art. The permanent magnet, however, must have its magnetic axis with a major component perpendicular to the rotation axis to control the rotor orientation. The locus of the poles 26N and 26S in relation to the pole piece tips are, however, of considerable importance. Normally, the clearance between the poles 26N and 26S and the pole piece tips 20 will be as small as possible. Rotor support is arranged to position the poles 26N, 26S in the plane of the tips 20.

Cores 12 are each provided with energizing coils 14.

An energization source for the coils 14 is not shown, but it will be understood that the coils may be individually energized to produce the desired operating sequence in the form shown with four cores 12 all connected to the same return plate, the coils 14 for opposing cores are connected in series and wound so that when pulsed in either sense to produce opposite polarities in opposing pole pieces. This results in 4 possible rotor positions.

With the coils so connected it will be obvious that opposite pole pieces 17A-17C or 17B-17D will be of opposite polarity and that the four adjacent pairs of pole piece tips 20 will provide opposed pairs of similar adjacent pole piece tips NN or SS and opposed pairs of differing pole piece tips NS and SN, as shown in FIG. 2 for the position of the rotor displaying Red in the viewing direction "V".

For simplicity in describing the operation of the device, the pole pieces are lettered clockwise from the top 17A, 17B, 17C, 17D, and it will be obvious that in the pole piece polarity shown in FIG. 2, the SS pair of adjacent tips 20 will attract the N pole of the rotor magnet 26, the NN tip pair will attract the S pole of rotor magnet 26, and display the red panel in the viewing direction "V". The SS and NN pairs provide flux with a strong radial component to maintain the rotor magnet centered at the desired orientation. On the other hand, the NS or SN tip pairs provide a (relatively) low impedance path for the magnetic flux and the flux at these tip pairs tends to have a much stronger component perpendicular to the radius but very little radial component to affect the permanent magnet. Such difference in relative flux strength is of particular importance when the pole pieces are switched to rotate the magnet 180° as hereinafter described.

In operation, with the pole pieces polarized and the rotor oriented as shown in FIG. 2, it will be obvious that reversing the polarization of pole pieces 17A-17C will rotate the permanent magnet 90° counterclockwise to display the yellow panel. Again, starting from the position of FIG. 2, reversal of the polarity of the pole pieces 17B and 17D, will produce a 90° clockwise rotation of the permanent magnet and the display of the black side in the viewing direction. Starting from the datum of FIG. 2, to rotate the rotor 180°, both pairs of pole pieces 17A-17C, and 17B-17D, are switched and the SS pair of pole piece tips then being between pole piece 17A and 17D, the rotor is rotated 180° so that pole N of magnet 26 aligns with the last mentioned tips. In swinging through 180°, the permanent magnet must pass one of the NS or SN tip pairs. However, the permanent magnet is very little affected by the polarity of the tips in the NS or SN tip pairs, since the flux there is mainly perpendicular to the radial direction rather than radial. When rotating the rotor 180°, it will avoid ambiguity in direction of turn if one of the pole piece pairs 17A-17C or 17B-17D, is switched a short time before the other. To give an idea of the times involved, with the present device, the order of such times is as follows:

Start switching pulse of one pole piece pair 10 milliseconds before the other;

Length of switching pulse each pole piece pair—½ to 1 millisecond;

Time of rotor to move 180°: 100-200 ms. dependant upon rotor inertia and flux gradient.

It is to be noted that the above values are not intended to be limiting in any way. They do, however, give an indication of the relation of the three defined intervals to each other.

As previously explained if low remanence, or soft iron cores are used then the length of the switching pulse must be of the order of the time it takes the rotor to move from the old to the new position. In fact, the switching time may have to be slightly longer than the rotor movement time to ensure that it settles down.

Thus, when it is desired to rotate the rotor 180° from the position indicated in FIG. 2, one pole piece pair, say 17A–17C, will be switched before the other. Immediately after the switching of 17A–17C, NS and SN tip pairs are created opposite the N and S poles, respectively, of the permanent magnet. The flux from the NS and SN tip pairs to the permanent magnet poles is comparatively reduced, and the rotor is induced to start turning counter-clockwise by the temporary existence of a SS tip pair between pole pieces 17A–17B and of a NN pole pieces tip pair between pole pieces 17C–17D. After about 10 ms and the rotor has started its turn, pole pieces 17B–17D are switched, creating NS tip pairs between 17A–17B and between 17C–17D with relatively low flux allowing the passage thereby of the permanent magnet poles. After the successive switching of 17A–17C and then 17B–17D, there is created an SS tip pair between pole pieces 17A–17 D and an NN tip pair between 17B–17C, causing the rotor to assume an orientation 180° from that shown in FIG. 2 and to display the green panel in the viewing direction.

The device so far described is shown with an upwardly directed shaft 16 and with the rotor maintained thereon by gravity. Obviously, any variation of the pivotal mounting is within the scope of the invention. The shaft may extend through the rotor, and will be provided with means not shown to prevent the rotor sliding off the shaft. Further, the rotor pivot axis may be horizontal (or any other orientation)-rather than vertical. In all arrangements, guide means will be provided to ensure that the permanent magnet 26 rotates in the proper special relationship to the pole piece tips 20.

FIG. 4 shows a three-position display element. Components analogous to FIGS. 1–3 bear the same number with 100 added. FIG. 4 shows a display element with three pole pieces 117A 117B, 117C. It is assumed that each of these will be connected by a high coercivity, high remanence core 112 to a low coercivity return plate (not shown but similar to plate 10). However, contrary to the preferred arrangement of the four pole piece device, each coil 114 in the three-position device should be separately energized. The pole pieces 117A, 117B, 117C are substantially co-planar like the pole pieces of FIG. 1 and encompass 120° less the angular spacing between tip pairs. With the pole pieces energized as indicated in FIG. 4, the three-panel rotor is oriented, as shown, with the N pole of the rotor magnet 126 directed at the only SS tip pair between pole pieces 117B–117C and the red panel displayed in the viewing direction. To display the yellow face, the pole pieces 117C and 117A are switched through their energizing coils so that the 117B–117C tip pair is NS, while the 117A–117B pair is SS. The NS tip pair has very little influence on the permanent magnet but the SS tip pair attracts the north pole of the permanent magnet to rotate the rotor 120° counter-clockwise and display the yellow panel in the viewing direction.

Starting from the position of FIG. 4, to display the green panel in the viewing direction 117A and 117B are switched. This creates a NS tip pair at 117B–117C and a SS tip pair at 117A–117C. Accordingly, the rotor will rotate 120° clockwise to display the green panel in the viewing direction.

It should be noted that this configuration employs only 3 of 6 possible rotor positions, and could be used as an alternative to that arrangement shown in FIG. 6.

Although energization methods may be devised for more than four colors and more than four rotor positions, for most practical purposes only three and four position rotors will be used. For five or more sided rotors, the area of the color to be displayed is less than the area profile of the rotor in the viewing direction, so that some of the rotor must be masked. This is particularly deleterious to the appearance of a display using a large number of elements, as described, in close array.

In the embodiments of FIGS. 1–3 or FIG. 4, the spacing of the tip pairs will have to be calculated taking into account the magnetic and electrical parameters of the circuit. If the tip pairs are too far apart, the position of the rotor will be indefinite since the rotor magnet points toward a NN or SS tip pair that is too widely spaced. Also, the unwanted radial flux at a NS tip pair may be too great. If the tip pairs are too close together the flux loss between tip pairs will be too great and will impair the flux required at SS and NN pairs.

The rotors shown are square or triangular in plan view. However, it will be realized that any other shape, e.g. cylindrical, may be used with the three or four colors distributed for selective display in the viewing direction.

FIGS. 5, 6 and 7 are exemplary of the pole piece arrangement and energization of rotors with 5, 6 and 7 positions respectively; 5, 6 and 7 pole pieces, 517, 617 717 respectively subtending (with one tip pair gap width between), 1/5, 1/6 and 1/7 of the 360° having the shape of the pole pieces of FIGS. 2 and 4 with the angular extent reduced and defining tip pairs, and having 5, 6 and 7 outer panels 523, 623, 723 respectively.

In FIG. 5, as SS tip pair at 12 o'clock attracts the N pole of the rotor magnet 526, it will be seen that near the 5 o'clock and 7 o'clock positions, alternate NN tip pairs attract the S pole of the rotor magnet. This potential positional ambiguity is resolved because there is only one SS tip pair to attract the N pole of the rotor magnet. It will be obvious that by correct switching of the pole piece polarities that the pattern of FIG. 5 may be reproduced in any of the four other alternative positions of the rotor magnet 526 allowing the selective display of any one of 5 panels 523 in the viewing direction "V". The pole pieces through their cores should be individually switched.

FIG. 6 where the components have a "600" prefix shows a six-position rotor with panels 623 and rotor magnet 626 and 6 pole pieces 617 each with a gap width encompassing 60°. The SS tip pair at the 12 o'clock position attracts the N pole of rotor magnet 626, which resolves the alternative "attractions" of the three NN tip pairs at the 4, 6 and 8 o'clock positions and ensures that the rotor magnet will point on the 12 o'clock - 6 o'clock axis. The pattern shown may be reproduced at any of the six possible orientations producing a six-position rotor which will display a selected one of the 6 panels 623 in the direction V. The pole pieces through their cores should be individually switched.

FIG. 7 shows a seven-position rotor and a pattern for attracting the N pole of the rotor magnet 723 to the 12 o'clock position. Switching the pole pieces can produce the pattern shown in seven orientations allowing the selective display of any one of seven panels 723 in the viewing direction.

It should also be noted that FIGS. 4, 5 and 7 show 3, 5 and 7 position indicators wherein the orientation of the rotor is primarily determined by a SS tip pair attracting the N pole of the rotor magnet. It will be noted that by reversing the polarities of the patterns shown, the polarities of all pole pieces would be reversed and a NN tip pair would attract the S pole of the rotor magnet (i.e. the rotor position would be rotated at 180° to that shown). By selective switching of the pole pieces to move the "reverse" pattern about, a further 3, 5 and 7 positions are attainable with the rotor, the new positions alternately with those originally described. Thus, the 3, 5 and 7 pole piece arrangements of FIGS. 4, 5 and 7 may be energized to produce respectively a 6, 10 and 14 position rotor and the rotor may, in such arrangements, have 6, 10 and 14 faces selectively available for display in the view direction.

I claim:

1. Display element comprising:

pivotally mounted rotor designed at each of 3 or 4 angular locations to display a different panel in a viewing direction, oriented generally perpendicular to the viewing axis, a permanent magnet mounted on said rotor to rotate therewith, defining a magnetic axis with its major component perpendicular to the rotational axis, the poles of said permanent magnet defining a circular locus on rotation about the axis of rotation, independently magnetizable pairs of pole piece tips of magnetic material adjacent but spaced from each other and together located adjacent the locus of a pole of said magnet at locations spaced by the angle between adjacent locations, means for magnetizing in the same polarity one tip at a given angular location and a tip at the next angular location in a predetermined direction whereby said pole piece tips as a whole may be magnetized so that at any one time only one of said pairs will be the same and of a given polarity.

2. Display device as claimed in claim 1 wherein there are provided means for energizing said pole piece tips having high remanence high coercivity cores with energizing windings thereon with one end thereof magnetically connected to said pole piece tips.

3. Display device as claimed in claim 2 wherein each said one core pole is magnetically connected to a tip associated with one angular location and to a tip associated with the next angular position, and the tip pairs corresponding to each angular position are associated with different combinations of pole pieces.

4. Display device as claimed in claim 3 wherein each said one core pole is connected to said tips by a pole piece located outside said locus and farther from said locus than said tips.

5. Display device as claimed in claim 3 wherein the rotor has four colored panels, each oriented at 90° to the next and the rotor has four angular locations at 90° to each other, and there are four cores connected at their ends magnetically remote from the respective tips by a return plate of low remanence magnetic material.

6. Display element as claimed in claim 5 where the cores corresponding to opposed pole pieces are provided with coils wound in series in respective senses so that on pulsing said coils in either sense, said pole pieces are given the opposite polarity.

7. Display device as claimed in claim 3, wherein the rotor has three colored panels each oriented at 120° to the next and the rotor has three angular locations at 120° to each other and there are three cores connected at their ends magnetically remote from the tips respective by a return plate of low remanence magnetic material.

8. Display device as claimed in claim 2 wherein said pole piece tips are of low remanence magnetic material.

9. Display device as claimed in claim 1 wherein each said one core pole is magnetically connected to a tip associated with one angular location and to a tip associated with the next angular position, and the tip pairs corresponding to each angular position are associated with different combinations of pole pieces.

10. Display device as claimed in claim 9 wherein each said one core pole is connected to said tips by a pole piece located outside said locus and farther from said locus than said tips.

11. Display device as claimed in claim 10 wherein the rotor has four colored panels, each oriented at 90° to the next and the rotor has four angular locations at 90° to each other, and there are four cores connected at their ends magnetically remote from the tips respective by a return plate of low remanence magnetic material.

12. Display element as claimed in claim 11 where the cores corresponding to opposed pole pieces are provided with coils wound in series in respective senses so that on pulsing said coils in either sense, said pole pieces are given the opposite polarity.

13. Display device as claimed in claim 11 wherein said pole pieces are flat plates substantially co-planar.

14. Display device as claimed in claim 10 wherein the rotor has three colored panels each oriented at 120° to the next and the rotor has three angular locations at 120° to each other and there are three cores connected at their ends magnetically remote from the tips respective by a return plate of low remanence magnetic material.

15. Display device as claimed in claim 14 wherein said pole pieces are flat plates substantially co-planar.

16. Display device as claimed in claim 10 wherein said pole pieces are flat plates substantially co-planar.

17. Display device as claimed in claim 7 wherein said pole piece tips are of low remanence magnetic material.

18. Display device as claimed in claim 17 wherein said pole pieces are flat plates substantially co-planar.

19. Display device as claimed in claim 1 wherein said pole piece tips are of low remanence magnetic material.

* * * * *